US009821244B1

(12) United States Patent
Whang

(10) Patent No.: US 9,821,244 B1
(45) Date of Patent: Nov. 21, 2017

(54) MAGNETIC WOODEN BLOCK TOY

(71) Applicant: Click-Block Corporation, Rolling Meadows, IL (US)

(72) Inventor: Byung Hui Whang, Chicago, IL (US)

(73) Assignee: CLICK-BLOCK CORPORATION, Rolling Meadows, IL (US)

( * ) Notice: Subject to any disclaimer, the term of this patent is extended or adjusted under 35 U.S.C. 154(b) by 0 days.

(21) Appl. No.: 15/347,298

(22) Filed: Nov. 9, 2016

(51) Int. Cl.
*A63H 33/04* (2006.01)
*A63H 33/06* (2006.01)

(52) U.S. Cl.
CPC ..... *A63H 33/046* (2013.01); *A63H 33/06* (2013.01)

(58) Field of Classification Search
CPC ..... A63H 33/046
USPC ..... 446/92, 129, 131
See application file for complete search history.

(56) References Cited

U.S. PATENT DOCUMENTS 5,347,253 A * 9/1994 Ogikubo ..... A63F 9/12 273/239
5,409,236 A * 4/1995 Therrien ..... A63F 9/1204 273/156
5,746,638 A * 5/1998 Shiraishi ..... A63H 33/046 446/131
6,749,480 B1 * 6/2004 Hunts ..... A63H 33/046 446/85
7,320,633 B2 * 1/2008 Park ..... A63H 33/046 446/131
7,413,493 B2 * 8/2008 Toht ..... A63H 33/046 273/156
7,887,056 B2 * 2/2011 Tenorio ..... A63F 9/1208 273/156
8,070,550 B2 * 12/2011 Song ..... A63H 33/046 446/129
8,128,452 B2 * 3/2012 Kim ..... A63H 33/046 446/129
8,850,683 B2 * 10/2014 Haughey ..... A63H 33/046 29/428
9,433,871 B2 * 9/2016 Park ..... A63H 33/102
2006/0111010 A1 * 5/2006 Park ..... A63H 33/046 446/92
2006/0240737 A1 * 10/2006 Yoon ..... A63H 33/046 446/92
2010/0022158 A1 * 1/2010 Kim ..... A63H 33/046 446/92
2010/0159794 A1 * 6/2010 Kim ..... A63H 33/046 446/92
2014/0213139 A1 * 7/2014 Ferguson ..... A63H 33/046 446/92
2015/0004869 A1 * 1/2015 Kim ..... A63H 33/046 446/92
2015/0065007 A1 * 3/2015 Klepper ..... A63H 33/046 446/92
2015/0283475 A1 * 10/2015 Hiller ..... A63H 33/046 446/92

* cited by examiner

*Primary Examiner* — Alexander Niconovich
(74) *Attorney, Agent, or Firm* — Levenfeld Pearlstein, LLC

(57) ABSTRACT

A magnetic wooden block toy configured to provide improved magnetic force between magnetic wooden blocks is provided. The magnetic wooden block toy includes a wooden body and at least one magnet casing embedded therein. The magnet casing includes a casing body, a flange having a sloped inner surface, and a top opening defined by the sloped inner surface. The magnet casing contains at least one magnet.

11 Claims, 3 Drawing Sheets

MAGNETIC WOODEN BLOCK TOY

BACKGROUND

The present disclosure relates to block toys, and more particularly to magnetic wooden block toys.

Magnetic block toys are provided in various sizes and shapes, such that users may build different structures for entertainment and educational purposes. Magnetic block toys may be used to build structures and reused upon disassembly. Magnetic block toys may be made from a polymeric material or wood and include a magnet.

Wooden block toys typically do not include magnets. In conventional wooden block toys, building structures are centered on balancing the blocks close to its center of mass. Without embedded magnets, structures made from the wooden blocks are more prone to accidental disassembly.

While the conventional wooden block toys rely solely on balance to create structures, structure building using magnetic wooden block toys is aided by the use of magnetic force. In use, magnets provide stability to structures built with magnetic wooden blocks. Thus, users may build larger and more stable structures using magnetic wooden blocks than using conventional wooden block toys.

Accidental disassembly poses challenges to users. Typically, when accidental disassembly occurs, a large portion of the structure falls apart and frustrates users. Thus, it is highly desirable to provide magnetic wooden block toys that can provide increased stability to structures built.

The present disclosure provides an improved magnetic wooden block toy for providing increased magnetic power and stability to structures according to various embodiments.

BRIEF SUMMARY

Wooden block toys including an embedded magnet contained in a casing configured to provide increased magnetic force are provided according to various embodiments.

In one aspect, a magnetic wooden block may include a wooden body and at least one magnet casing containing at least one magnet embedded in the wooden body. The magnet casing may include a casing body, a flange radially extending from the casing body and including a sloped inner surface, and a top opening defined by the sloped inner surface. In an embodiment, the casing body may include a bottom opening. In such an embodiment, the magnet casing may include a bottom cap configured to fit in the bottom opening.

In an embodiment, the flange may include a top edge and a bottom edge, in which the sloped inner surface extends between the top edge and the bottom edge and define the top opening. In such an embodiment, a diameter of the top opening at the top edge is smaller than a diameter of the top opening at the bottom edge.

The magnet may have a body having various shapes. For example, the magnet may have a spherical body having a diameter greater than the diameter of the top opening at the top edge. In another example, the magnet may have a cylindrical body having a diameter greater than the diameter of the top opening at the top edge.

The wooden body may include a plurality of surfaces, in which the magnet casing may be arranged such that the flange is even or flushed with at least one of the plurality of surfaces.

In an embodiment, the magnet casing may have a cylindrical body and a tapered bottom portion.

In another aspect, a method of making any of the foregoing magnetic wooden block is provided. The method may include the steps of providing at least one opening in the wooden body having a diameter smaller than a largest diameter of the casing body, and inserting the magnet casing containing the at least one magnet into the opening.

The method may also include the step of proving at least one magnet casing having a cylindrical body and a tapered bottom portion, in which the tapered bottom portion has a diameter smaller than a diameter of the cylindrical body. In such an embodiment, the step of providing at least one opening may include drilling an opening on a surface of the wooden body, wherein the diameter of the opening is generally same as the diameter of the tapered bottom portion. Further, the step of inserting may include arranging the tapered bottom portion in the opening and press fitting the rest of the magnet casing into the opening. In some embodiment, the method may also include the step of applying an adhesive or glue in the opening.

In yet another aspect, a magnet casing for a magnetic block toy may include a casing body and at least one magnet contained in the magnet casing. The magnet casing may also include a flange radially extending from the casing body and including a sloped inner surface, and a top opening defined by the sloped inner surface. The magnet casing containing the at least one magnet may be arranged in a magnetic block toy. In an embodiment, the casing body may include a bottom opening. In such an embodiment, the magnet casing may also include a bottom cap configured to fit in the bottom opening.

The flange may include a top edge and a bottom edge, in which the sloped inner surface extends between the top edge and the bottom edge and defines the top opening. In such an embodiment, a diameter of the top opening at the top edge may be smaller than a diameter of the top opening at the bottom edge.

The magnet may have a body having various shapes. For example, the magnet may have a spherical body having a diameter greater than the diameter of the top opening at the top edge. In another example, the magnet may have a cylindrical body having a diameter greater than the diameter of the top opening at the top edge.

Other aspects, objectives and advantages will become more apparent from the following detailed description when taken in conjunction with the accompanying drawings.

BRIEF DESCRIPTION OF THE DRAWINGS

The benefits and advantages of the present embodiments will become more readily apparent to those of ordinary skill in the relevant art after reviewing the following detailed description and accompanying drawings, wherein.

DETAILED DESCRIPTION

Figure 1:
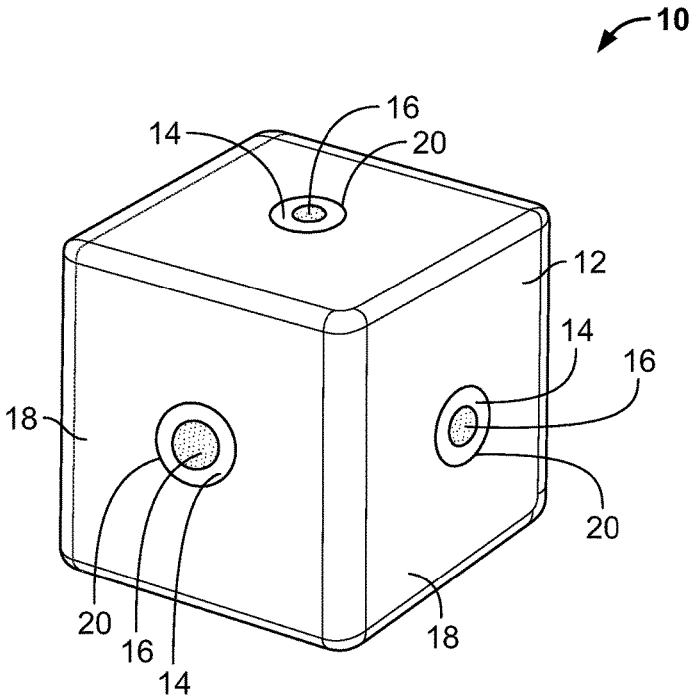
FIG. 1 is an illustration of a magnetic wooden block toy according to an embodiment.
Figure 2:
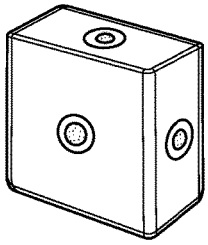
FIGS. 2-14 are illustrations of magnetic wooden block toys according to various embodiments.
Figure 3:
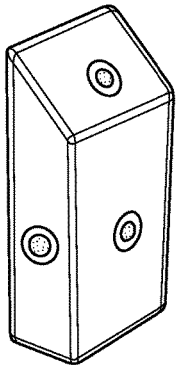
Figure 4:
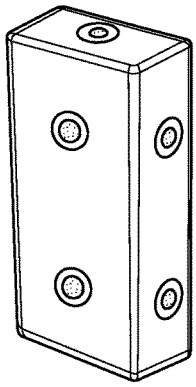
Figure 5:
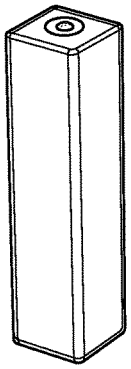
Figure 6:
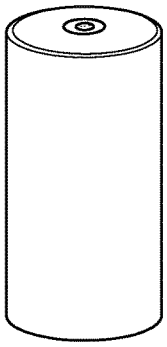
Figure 7:
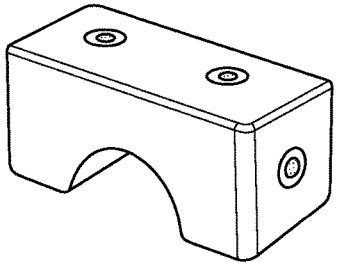
Figure 8:
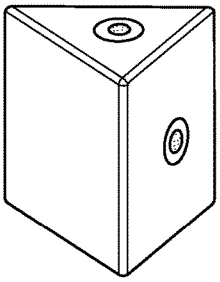
Figure 9:
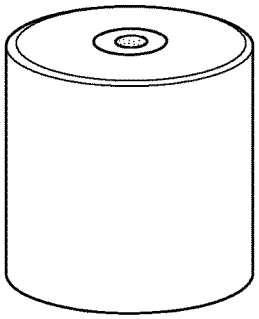
Figure 10:
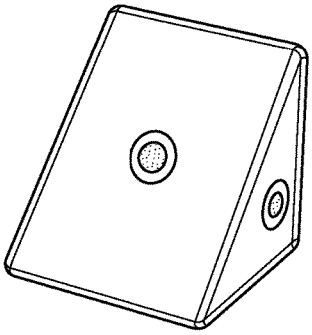
Figure 11:
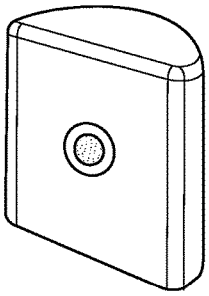
Figure 12:
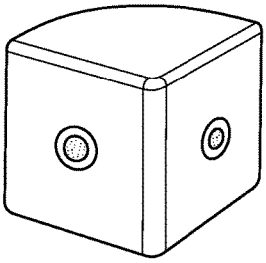
Figure 13:
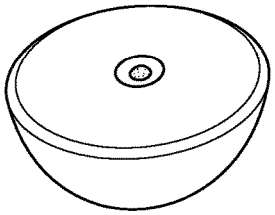
Figure 14:
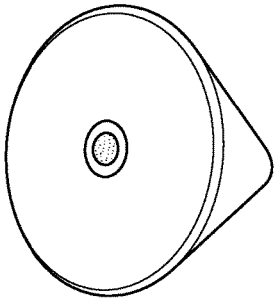

While the present disclosure is susceptible of embodiment in various forms, there is shown in the drawings and will hereinafter be described presently preferred embodiments with the understanding that the present disclosure is to be considered an exemplification and is not intended to limit the disclosure to the specific embodiments illustrated.

Referring to FIG. 1, a magnetic wooden block 10 according to an embodiment is shown. The magnetic wooden block 10 may generally include a body 12, at least one magnet casing 14, and at least one magnet 16 contained therein. In this embodiment, the magnetic wooden block 10 has a generally cube-like shape body 12 including six surfaces 18. In other embodiments, magnetic wooden blocks may have various shape bodies, for example, as shown in FIGS. 2-14.

The magnetic wooden block 10 may include a plurality of magnet casings 14, each of which containing a magnet 16 therein. The plurality of magnet casings 14 may be arranged in various locations in the magnetic wooden block 10. In the embodiment of FIG. 1, the magnetic wooden block 10 includes six magnet casings 14, each containing a magnet 16 and arranged in each of the six surfaces 18 of the body 12. In this embodiment, each of the magnet casing 14 is generally centered on each of the surfaces 18. In other embodiments, a magnet casing may be off centered on a surface, and/or more than one magnet casings may be provided in a surface, for example, as the embodiments shown in FIGS. 4 and 7.

In the embodiment of FIG. 1, the magnetic wooden block 10 includes six openings 20, each of which is provided in each of the six surfaces 18. Each of the openings 20 is configured such that the magnet casing 14 may tightly fitted in the opening 20 and may not come loose from the opening 20 even under strong impact.

Figure 15D:
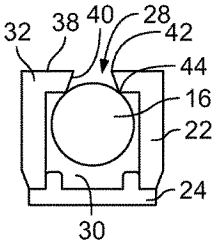
FIGS. 15A-D are schematic illustrations of a magnet casing containing a magnet according to an embodiment.
Figure 15C:
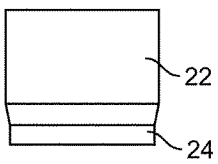
Figure 15B:
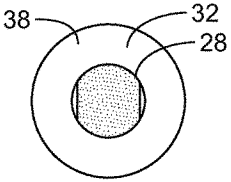
Figure 15A:
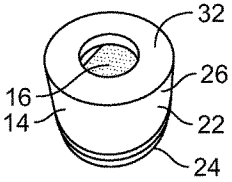

The magnet casing 14 containing the magnet 16 according to an embodiment is illustrated in FIGS. 15A-D. FIG. 15A is a schematic perspective view, FIG. 15B is a schematic top view, FIG. 15C is a schematic side view, and FIG. 15D is a schematic cross sectional view of the magnet casing 14 containing the magnet 16. The magnet casing 14 may generally include a top casing 22 and a bottom cap 24.

Figure 16A:
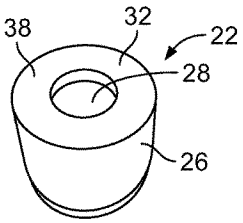
FIGS. 16A-B are schematic illustrations of a top casing of the magnet casing of FIGS. 15A-D.
Figure 16B:
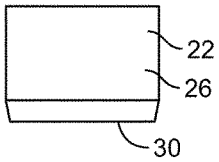

The top casing 22 may have a generally cylindrical body 26 including a top opening 28 and a bottom opening 30 as illustrated in FIGS. 16A-B. The top opening 28 may be defined by an inner peripheral surface 40 of a flange 32 extending radially from the cylindrical body 26. The top opening 28 may have a diameter less than a largest diameter of the magnet 16, such that the magnet 16 may be contained within the magnet casing 14. The cylindrical body 26 may be tapered proximate the bottom opening 30.

Figure 17A:
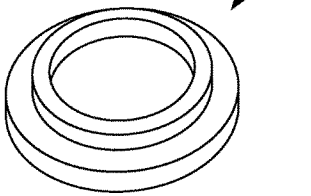
FIGS. 17A-B are schematic illustrations of a bottom cap of the magnet casing of FIGS. 15A-D.
Figure 17B:
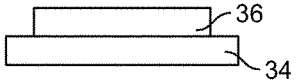

The bottom cap 24 may include a bottom portion 34 and a cylindrical wall 36 as shown in FIGS. 17A-B. The bottom cap 24 may be configured to close the top casing 22 when the cylindrical wall 36 of the bottom cap 24 is fitted in the bottom opening 30 of the top casing 22, thereby containing the magnet 16 within the magnet casing 14. The bottom portion 34 may have the same diameter as the diameter of the tapered portion of the top casing 22 proximate the bottom opening.

The magnet casing 14 may be configured to minimize a distance between the magnet 16 and a top surface 38 of the magnet casing 14 to maximize magnetic force between adjacent magnetic wooden blocks in a structure. In such a configuration, a distance between magnets in the adjacent magnetic wooden blocks may be reduced by allowing the magnets to approach closer to the top surface 38, thereby improving the magnetic force between the adjacent magnetic blocks to improve stability of the structure.

Figure 18:
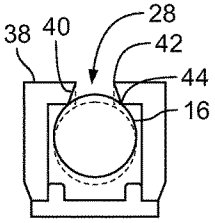
FIG. 18 is a schematic cross sectional illustration of a magnet casing of FIGS. 15A-D including an opening with a slanted inner peripheral surface compared to a magnet casing including an opening with an unslanted inner peripheral edge.

In an embodiment, the magnet casing 14 may include the flange 32 having a sloped inner surface 40, in which the opening 28 is defined. The sloped inner surface 40 may include a top edge 42, which extends radially further than a bottom edge 44. As such, a diameter of the opening 28 may gradually increase from the top edge 42 to the bottom edge 44, in which the diameter of the opening 28 at the top edge 42 is smaller than the diameter of the opening 28 at the bottom edge 44. The magnet casing 14 including the sloped inner surface 40 may allow the magnet 16 to move closer to the top surface 38 when compared to a magnet casing including an unsloped inner surface as illustrated in FIG. 18. In FIG. 18, the position of a magnet in a magnet casing with an unsloped inner surface is illustrated in phantom lines for easy comparison.

The magnet casing 14 may be formed from a suitable non-magnetic material, such as polymeric material. In an embodiment, the top casing 22 and the bottom cap 24 may be injection molded using a suitable plastic material.

In a method of making a magnetic wooden block 10 according to an embodiment, an opening 20 may be drilled in a surface 18 to provide a generally cylindrical opening having a diameter slightly smaller than a largest outer diameter of the magnet casing 14. For example, the opening 20 may be drilled to have a similar diameter as the diameter of the tapered lower portion of the magnet casing 14. The tapered lower portion of the magnet casing 14 may be inserted in the opening 20, and the rest of the magnet casing may be press fitted into the opening 20, such that the magnet casing 14 is tightly fitted into the opening 20. The magnet casing 14 may be arranged in the magnetic wooden block 10, such that the top surface 38 is generally flush with a surface of the magnetic wooden block.

In some embodiments, an adhesive or glue may be used to further secure the magnet casing 14 in the opening 20. In such embodiments, an adhesive or glue may be applied in the opening 20 prior to inserting the magnet casing 14, such that the adhesive or glue may securely attach the magnet casing 14 in the opening 20. When each of the magnet casings 14 containing the magnet 16 is secured in each of the openings 20, the magnetic wooden block 10 including a plurality of magnets 16 may be provided.

All patents referred to herein, are hereby incorporated herein in their entirety, by reference, whether or not specifically indicated as such within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present disclosure. It is to be understood that no limitation with respect to the specific embodiments illustrated is intended or should be inferred. The disclosure is intended to cover by the appended claims all such modifications as fall within the scope of the claims.

What is claimed is:

1. A magnetic wooden block comprising:

a wooden body;

at least one magnet casing comprising:

a casing body including an upper portion having a first diameter and a tapered bottom portion having a second diameter, wherein the second diameter is smaller than the first diameter;

a flange radially extending from the casing body, the flange including a sloped inner surface;

a top opening defined by the sloped inner surface; and at least one magnet contained in each of the at least one magnet casing;

wherein each of the at least one magnet casing containing the at least one magnet is embedded in the wooden body;

wherein the wooden body includes at least one opening having an initial diameter that is about same as the second diameter and smaller than the first diameter, wherein the magnet casing is embedded by inserting the tapered bottom portion in the opening and press fitting the magnet casing, such that the magnet casing is tightly fitted into the opening.

2. The magnetic wooden block of claim 1, wherein the casing body includes a bottom opening, and the at least one magnet casing includes a bottom cap configured to fit in the bottom opening.

3. The magnetic wooden block of claim 1, wherein the flange includes a top edge and a bottom edge, wherein the sloped inner surface extends between the top edge and the bottom edge and defines the top opening, wherein a diameter of the top opening at the top edge is smaller than a diameter of the top opening at the bottom edge.

4. The magnetic wooden block of claim 3, wherein the at least one magnet has a spherical body having a diameter greater than the diameter of the top opening at the top edge.

5. The magnetic wooden block of claim 3, wherein the at least one magnet has a cylindrical body having a diameter greater than the diameter of the top opening at the top edge.

6. The magnetic wooden block of claim 1, wherein the wooden body includes a plurality of surfaces, wherein each of at least one magnet casing is arranged such that the flange is even with at least one of the plurality of surfaces.

7. The magnetic wooden bock of claim 1, wherein the at least one magnet casing has a cylindrical body and a tapered bottom portion.

8. A method of making a magnetic wooden block of claim 1, the steps comprising:

providing at least one opening in the wooden body having a diameter smaller than a largest diameter of the casing body; and inserting each of the at least one magnet casing including the at least one magnet into the opening.

9. The method of claim 8, wherein the at least one magnet casing has a cylindrical body and a tapered bottom portion, wherein the tapered bottom portion has a diameter smaller than a diameter of the cylindrical body; wherein the step of providing at least one opening includes drilling an opening on a surface of the wooden body, wherein the diameter of the opening is same as the diameter of the tapered bottom portion.

10. The method of claim 9, wherein in the step of inserting includes arranging the tapered bottom portion in the opening and press fitting the magnet casing into the opening.

11. The method of claim 8 comprising applying an adhesive or glue in the at least one opening.

* * * * *